US011612775B2

(12) United States Patent
Ringer et al.

(10) Patent No.: US 11,612,775 B2
(45) **Date of Patent: *Mar. 28, 2023**

(54) CPVC SPRINKLER ASSEMBLY WITH SUPPORT MEMBER

(71) Applicant: Tyco Fire Products LP, Lansdale, PA (US)

(72) Inventors: Yoram Ringer, Providence, RI (US); Pedriant Pena, Berkley, MA (US)

(73) Assignee: Tyco Fire Products LP, Lansdale, PA (US)

( * ) Notice: Subject to any disclaimer, the term of this patent is extended or adjusted under 35 U.S.C. 154(b) by 19 days.

This patent is subject to a terminal disclaimer.

(21) Appl. No.: 17/161,372

(22) Filed: Jan. 28, 2021

(65) Prior Publication Data

US 2021/0146178 A1 May 20, 2021

Related U.S. Application Data

(63) Continuation of application No. 16/117,732, filed on Aug. 30, 2018, now Pat. No. 10,905,909, which is a (Continued)

(51) Int. Cl.

| | |
|---|---|
| ***A62C 35/64*** | (2006.01) |
| ***A62C 37/09*** | (2006.01) |
| ***A62C 35/68*** | (2006.01) |

(52) U.S. Cl.

CPC ..... *A62C 35/64* (2013.01); *A62C 35/68* (2013.01); *A62C 37/09* (2013.01)

(58) Field of Classification Search

CPC ..... A62C 37/00; A62C 37/08; A62C 37/09; A62C 35/64; A62C 35/68; A62C 37/10; (Continued)

(56) References Cited

U.S. PATENT DOCUMENTS 2,389,334 A * 11/1945 Tyden ..... A62C 37/09 169/40
3,633,676 A * 1/1972 Gloeckler ..... A62C 37/09 169/40

(Continued)

FOREIGN PATENT DOCUMENTS

WO WO-2013/010098 A2 1/2013

OTHER PUBLICATIONS

International Search Report and Written Opinion on PCT Appl. Ser. No. PCT/US2014/025034 dated Oct. 9, 2014 (10 pages).

(Continued)

*Primary Examiner* — Christopher R Dandridge
(74) *Attorney, Agent, or Firm* — Foley & Lardner LLP

(57) ABSTRACT

A sprinkler assembly that includes a deflector assembly that translates with respect to the sprinkler frame upon actuation of the sprinkler from an unactuated state. The sprinkler frame includes a support member having an annular member spaced from the outlet to limit or control the axial translation of the deflector assembly relative to the outlet. Moreover, the annular member includes a region to support a closure assembly and thermally responsive trigger assembly under a fluid static load. A cover plate assembly includes a flexible annular wall to allow the cover plate assembly to be pushed on and held about the annular member of the sprinkler frame.

17 Claims, 5 Drawing Sheets

Related U.S. Application Data continuation of application No. 14/774,618, filed as application No. PCT/US2014/025034 on Mar. 12, 2014, now abandoned.

(60) Provisional application No. 61/780,840, filed on Mar. 13, 2013.

(58) Field of Classification Search
CPC ..... A62C 37/11; A62C 37/12; A62C 37/14; A62C 37/16; A62C 35/58
See application file for complete search history.

(56) References Cited

U.S. PATENT DOCUMENTS

| | | | | |
|---|---|---|---|---|
| 4,618,002 | A | 10/1986 | Mears | |
| 4,796,710 | A | 1/1989 | Job | |
| 5,080,176 | A * | 1/1992 | Polan | A62C 37/14 169/41 |
| 5,234,059 | A | 8/1993 | Eynon | |
| 5,494,114 | A * | 2/1996 | Hoening | A62C 37/14 169/37 |
| 5,664,630 | A | 9/1997 | Meyer et al. | |
| 6,308,784 | B1 * | 10/2001 | Mears | B05B 1/265 169/37 |
| 6,450,265 | B1 | 9/2002 | Ponte | |
| 6,868,916 | B2 | 3/2005 | Petersen | |
| 7,104,335 | B2 | 9/2006 | Shim | |
| 7,201,234 | B2 | 4/2007 | Rogers et al. | |
| 8,074,725 | B2 | 12/2011 | Rogers et al. | |
| 8,151,897 | B1 | 4/2012 | Meyer et al. | |
| 8,353,356 | B2 | 1/2013 | Rogers | |
| 8,376,060 | B2 | 2/2013 | Orr et al. | |
| 8,381,825 | B1 | 2/2013 | Golinveaux et al. | |
| 8,776,903 | B2 | 7/2014 | Jimenez et al. | |
| 8,869,906 | B2 | 10/2014 | Thompson | |
| 2006/0102362 | A1 | 5/2006 | Polan | |
| 2009/0056958 | A1 | 3/2009 | Polan | |
| 2009/0126950 | A1 | 5/2009 | Rogers | |
| 2010/0212917 | A1 | 8/2010 | Mehr | |
| 2010/0263883 | A1 | 10/2010 | Abels et al. | |
| 2011/0030977 | A1 | 2/2011 | Polan et al. | |
| 2011/0180277 | A1 | 7/2011 | Jimenez et al. | |
| 2011/0203814 | A1 | 8/2011 | Thompson | |
| 2012/0090700 | A1 * | 4/2012 | Multer | F16L 19/025 137/357 |
| 2014/0262356 | A1 | 9/2014 | Ringer | |
| 2014/0262357 | A1 | 9/2014 | Ringer | |
| 2014/0346256 | A1 | 11/2014 | Abels et al. | |

OTHER PUBLICATIONS

Jan. 5, 2016 IFW of U.S. Appl. No. 61/780,840, filed Mar. 13, 2013.
KUWATCH "The Benefits of CPVC Fire-Sprinkler Systems" Buildings, http://buildings.com/article-details/articleid/6009/title/the-benefits-of-cpvc-fire-sprinkler-systems; May 2008 (7 pages).
Tyco Fire & Building Products, BlazeMaster® CPVC Fire Sprinkler Data Sheet TFP1915, Jun. 2008, 2 pages.
Underwriters Laboratories Inc. UL 1626 11 Standard for Safety for Residential Sprinklers for Fire Protection Service, Mar. 2008; Rev. Apr. 2012 (79 pages).

* cited by examiner

CPVC SPRINKLER ASSEMBLY WITH SUPPORT MEMBER

CROSS-REFERENCE TO RELATED APPLICATIONS

The present application is a continuation of U.S. patent application Ser. No. 16/117,732, filed Aug. 30, 2018, titled "CPVC SPRINKLER ASSEMBLY WITH SUPPORT MEMBER," which is a continuation of U.S. patent application Ser. No. 14/774,618, filed Sep. 10, 2015, titled "CPVC SPRINKLER ASSEMBLY WITH SUPPORT MEMBER," which is a 35 U.S.C. § 371 application of International Application No. PCT/US2014/025034 filed Mar. 12, 2014, which claims the benefit of and priority to U.S. Provisional Patent Application No. 61/780,840, filed Mar. 13, 2013, each of which is incorporated herein by reference in its entirety.

TECHNICAL FIELD

The present invention relates generally to fire protection devices and, more specifically, to sprinkler assemblies and the arrangement and operation of their components.

BACKGROUND OF THE INVENTION

Sprinklers employing drop down deflector assemblies are well-known. U.S. Pat. Nos. 8,353,356; 5,664,630 and U.S. Patent Publication No. 20100263883 show a water distributing deflector member coupled to a sprinkler frame body in which the deflector translates relative to the sprinkler frame from an unactuated position to an actuated position. In the actuated state of the sprinkler, water is discharged from the sprinkler frame outlet and impacts the deflector member. In these known sprinklers, a pair of guide pins is attached or affixed to the deflector member. The pins are disposed within through holes or bores formed in the sprinkler frame body or other structure mounted about the sprinkler frame body which supports the deflector under the load of the discharging water to provide the desired water distribution to address a fire. The through holes are positioned and dimensioned about the sprinkler frame body to allow the guide pins to slide and provide the desired deflector translation. Accordingly, known drop down deflector assemblies involve multiple interconnected components including the separate guide pins. It would be desirable to provide a more simplified assembly that eliminates the use of guide pins.

DISCLOSURE OF INVENTION

Preferred embodiments of a sprinkler assembly provide for a pendent sprinkler assembly that includes a sprinkler frame, preferably formed from a plastic material, having an outlet for the discharge of a fire fighting fluid, such as water. The sprinkler assembly includes a deflector assembly that translates with respect to the sprinkler frame upon actuation of the sprinkler from an unactuated state. The sprinkler frame includes a support member having an annular member spaced from the outlet to limit or control the axial translation of the deflector assembly relative to the outlet. Moreover, the annular member includes a region to support a closure assembly and a thermally responsive trigger assembly under a fluid static load.

One preferred embodiment includes a sprinkler assembly includes a sprinkler frame body having a proximal portion, a distal portion, an external surface and an internal surface.

The internal surface defines an internal passageway extending from an inlet formed in the proximal portion to an outlet formed in the distal portion to define a longitudinal sprinkler axis of the sprinkler assembly. A support member is preferably formed about the distal portion of the body for supporting a deflector assembly. The support member preferably includes a ring and a pair of stanchions disposed about the outlet. Each of the stanchions has a proximal end and a distal end with a lateral surface extending between the proximal end and the distal end. The lateral surface preferably defines an axial channel extending parallel to the longitudinal axis. The proximal end of the stanchions are preferably formed about the distal portion of the body and the distal end of the stanchions are preferably formed with the ring so as to space the ring distally from the outlet with the ring circumscribing and orthogonal to the longitudinal axis. The ring has a proximal surface and a distal surface preferably with a pair of closed-form apertures with each aperture extending from the distal surface to the proximal surface and in communication with the channel.

A deflector assembly is preferably engaged with the support member for translation from a first location relative to the outlet in an unactuated state of the sprinkler assembly to a second location relative to the outlet in an actuated state of the sprinkler assembly. The deflector assembly includes a deflector member and a pair of elongate members extending from the deflector member. Each elongate member is disposed in one of the axial channels and includes a projection member that engages the proximal surface of the ring in the second location of the deflector assembly. The proximal surface of the ring preferably includes a pair of engagement surfaces disposed about the longitudinal axis for engaging the projection members of the deflector assembly. The engagement surface preferably extends proximally into one of the channels from the proximal surface of the annular member and oblique to the lateral surface of the stanchion.

Another preferred embodiment of the sprinkler assembly includes a body having a proximal portion, a distal portion, an external surface and an internal surface. The internal surface defines an internal passageway extending from an inlet formed in the proximal portion to an outlet formed in the distal portion to define a longitudinal sprinkler axis of the sprinkler assembly. A pair of stanchions are disposed about the body defining a pair of spaced apart lateral channels. An annular member is spaced distally from the outlet by the stanchion and has a proximal surface, a distal surface and a peripheral surface extending between the proximal and distal surfaces. The peripheral surface preferably circumscribes the pair of lateral channels. A deflector assembly including a deflector member is disposed distally of the annular member for translation relative to the outlet of the body. The deflector assembly preferably engages the distal surface of the annular member to define a first location of the deflector assembly in an unactuated state of the sprinkler assembly. The deflector assembly engaging the proximal surface of the annular member in an actuated state.

Another preferred embodiment of a sprinkler assembly includes a body having a proximal portion, a distal portion, an external surface and an internal surface. The internal surface preferably defines an internal passageway extending from an inlet formed in the proximal portion to an outlet formed in the distal portion to define a longitudinal sprinkler axis of the sprinkler assembly. A closure assembly and a thermally responsive trigger maintains the closure assembly in the outlet in the unactuated state of the sprinkler. A preferred support member is formed about the distal portion of the body for supporting a deflector assembly. The support member preferably includes an annular member spaced distally from the outlet and defining a central axis coaxial with the longitudinal axis. The annular member has a proximal surface including a first portion and a second portion diametrically opposed about the central axis, the first and second portions extending radially toward the central axis. A bridge has a first end engaged with the first portion and a second end engaged with the second portion of the proximal surface of the annular member to support the closure assembly and the thermally responsive trigger aligned along the longitudinal axis.

Another preferred embodiment of a sprinkler assembly includes a sprinkler assembly that includes a body having a proximal portion, a distal portion, an external surface and an internal surface. The internal surface defines an internal passageway extending from an inlet formed in the proximal portion to an outlet formed in the distal portion to define a longitudinal sprinkler axis of the sprinkler assembly. A pair of stanchions are preferably disposed about the body and define a pair of spaced apart lateral channels. A deflector assembly is provided for translation from a first location relative to the outlet in an unactuated state of the sprinkler assembly to a second location relative to the outlet in an actuated state of the sprinkler assembly with the second location being distal of the first location. The deflector assembly includes a deflector member and a pair of elongate members extending from the deflector member. Each elongate member is preferably disposed in one of the axial channels and includes a projection member. A support surface is preferably spaced distally from the outlet by the stanchions and disposed about the pair of lateral channels. The support surface includes a pair of engagement surfaces for engaging the projection members of the deflector assembly in its second location. Each engagement surface extends proximally into one of the channels from the proximal surface of the annular member and oblique to the lateral surface of the stanchion.

BRIEF DESCRIPTION OF DRAWINGS

The accompanying drawings, which are incorporated herein and constitute part of this specification, illustrate exemplary embodiments of the invention and, together with the general description given above and the detailed description given below, serve to explain the features of the exemplary embodiments of the invention.

MODE(S) FOR CARRYING OUT THE INVENTION

Figure 1:
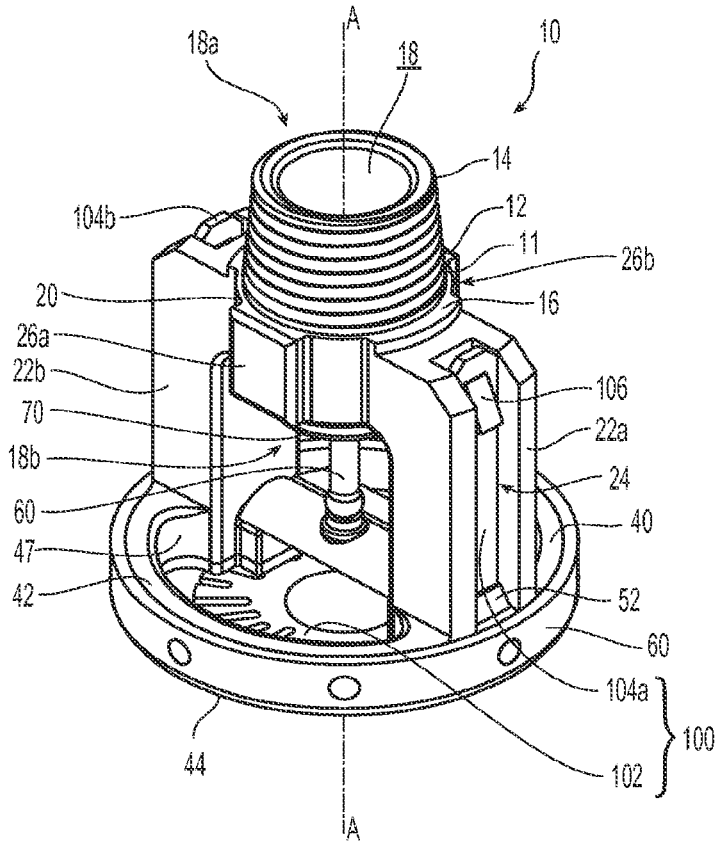
FIG. 1 is a perspective view of a preferred fire sprinkler assembly.

Shown in FIG. 1 is a first illustrative embodiment of a preferred fire protection sprinkler assembly 10. The preferred assembly 10 includes a sprinkler frame 12 and a deflector assembly 100 engaged with the sprinkler frame 12. The sprinkler frame has a proximal portion 14 for coupling the sprinkler assembly 10 to a fluid supply pipe network and a distal portion 16 for supporting the deflector assembly 100. The proximal portion 14 is configured for receipt of a fire fighting fluid, e.g. water, at the inlet 18*a* of an internal fluid passageway 18 for discharge from its outlet 18*b* formed at the distal portion 16 of the sprinkler frame 12. The sprinkler assembly 10 includes a thermally responsive trigger assembly 60 to control operation of the sprinkler assembly 10 between an unactuated state and an actuated state. In the unactuated state, the thermally responsive trigger assembly 60 maintains a seal assembly 70 to seal the outlet 18*b* of the sprinkler frame 12. The preferred seal assembly 70 preferably includes a seal and seal support at the outlet 18*b* of the passageway 18 to prevent fluid from exiting the outlet 18*b* of the passageway 18 until the trigger assembly 60 has actuated. In response to a sufficient amount of heat from, for example a fire event, the thermally responsive trigger assembly 60 operates to place the sprinkler assembly and release the seal assembly 70 from the outlet 18*b*. Once actuated, water is discharged from the outlet to impact the deflector assembly 100 for distribution of water in a pattern and/or density for addressing a fire in a desired manner. In the preferred operation of the deflector assembly 100, the deflector assembly translates axially and distally with respect to the sprinkler frame 12 and the outlet 18*b*. Accordingly, the preferred embodiments provide sprinkler assemblies which can be configured and/or assembled as either a drop-down pendent, a concealed pendent or a sidewall sprinkler.

The preferred sprinkler frame 12 includes a body 11 having internal and external surfaces which individually or together define the proximal portion 14, the distal portion 16 and the internal passageway 18 to further define the longitudinal axis A-A of the sprinkler assembly 10. The sprinkler frame 12 is preferably formed from a plastic body. The sprinkler frame is preferably formed from a plastic material, such as for example, Chlorinated Polyvinyl Chloride (CPVC) material, more specifically CPVC material per ASTM F442 and substantially similar to the material used to manufacture the BLAZEMASTER® CPVC sprinkler pipe and fittings as shown and described in the technical data sheet, TFP1915: "Blazemaster CPVC Sprinkler Pipe and Fittings Submittal Sheet" (June 2008).

In order to couple the sprinkler assembly 10 to an end of a pipe or pipe fitting of a fluid supply line in the piping network, the proximal portion 14 can include an external thread, such as for example, nominally sized tapered National Pipe Thread (NPT). The external thread preferably ranges in nominal sizes: ½ inch to 1 inch NPT. Alternatively, in one preferred configuration and installation of the sprinkler assembly, the proximal portion 14 can include an external coarse pipe thread for engagement with a corresponding internal threaded pipe fitting such as for example a plastic pipe fitting or component as shown and described in PCT Application Publication No. WO 2013/010098 of PCT Application No. PCT/US2012/046717, filed 13 Jul. 2012. Preferably, the external thread is a straight pipe thread such as, for example, American Standard straight pipe thread (NPS) or a cylindrical thread such as, for example, Whitworth-pipe thread, DIN/ISO 228.

The distal portion 16 of the sprinkler body 11 preferably includes and is more preferably formed with a support member 20. The support member is preferably configured to engage and support the deflector assembly 100 in order to: (i) support the trigger assembly 60 and seal assembly 70 in an unactuated state of the sprinkler assembly 10; and (ii) permit, control and or limit the deflector assembly 100 to translate from a first location at a first distance relative to the outlet 18*b* in an unactuated state of the sprinkler assembly to a second location at a second distance relative to the outlet 18*b* and distal of the first location in an actuated state of the sprinkler assembly 10. The support member 20 is preferably integrally formed at the distal end portion 16*a* of the sprinkler frame 12, although the support member may be formed axially anywhere along the sprinkler frame 12 provided it can support and affix the deflector assembly 40 as described herein.

Figure 2:
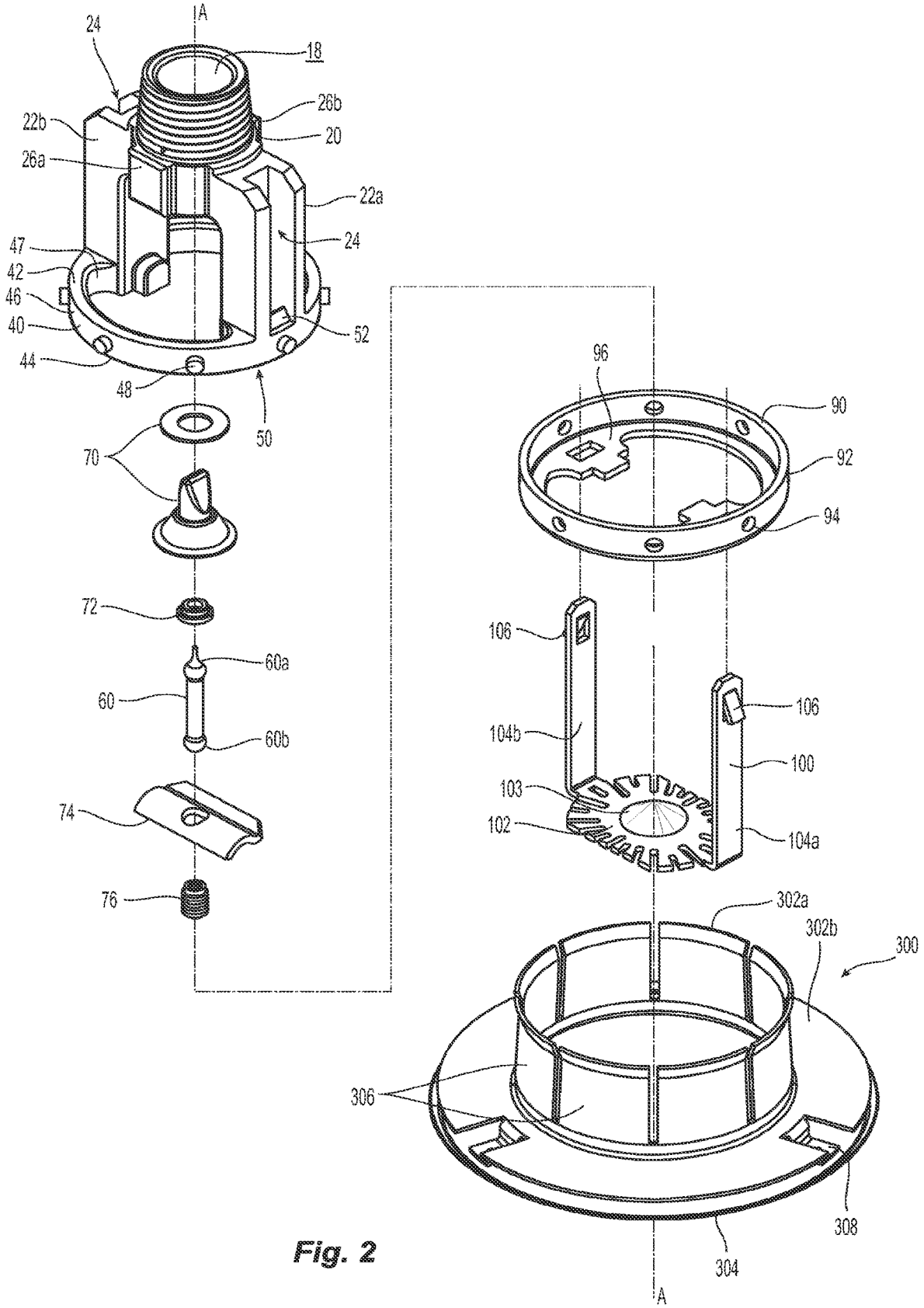
FIG. 2 is an exploded perspective view of the assembly of FIG. 1.

The support member 20 is preferably continuously formed about the sprinkler frame to surround and more preferably circumscribe the sprinkler axis A-A. With reference to FIGS. 1 and 2, preferably radially disposed about the support member 20 are one or more posts or stanchions 22 extending in the axial and preferably distal direction. More preferably, the support member 20 includes a pair of stanchions 22*a*, 22*b* disposed about the body 12, the passageway 18 and the longitudinal axis A-A. To facilitate installation, the distal portion 16 of the body 11 or the support member 20 includes a pair of tool engagement surfaces 26*a*, 26*b* disposed orthogonally to the stanchions 22*a*, 22*b*. The tool engagement surfaces 26*a*, 26*b* can be substantially flat surfaces for engaging a tool such as, for example, a wrench.

Each of the stanchions 22*a*, 22*b* has a proximal end and a distal end with a lateral surface extending between the proximal end and the distal end. The lateral surface defines an axial channel 24 extending parallel to the longitudinal axis A-A. More preferably, the lateral surface of the stanchions preferably includes three adjacent and orthogonally oriented surfaces to define a preferably three-sided open channel 24. The proximal ends of the stanchions 22*a*, 22*b* are preferably formed about the distal portion of the body. Preferably formed about the distal end of the stanchions is an annular member or ring 40 defining a central axis. Accordingly, the stanchions 22 preferably space the annular member 40 distally from the outlet with the annular member circumscribing and disposed preferably orthogonal to the longitudinal axis A-A.

The annular member 40 includes a proximal surface 42 and a distal surface 44 with a peripheral surface 46 and an internal surface 47 extending between the proximal and distal surfaces 42, 44. In one embodiment of the sprinkler assembly 10, a plurality of projection members 48 can be formed about the peripheral surface 46 for supporting a preferably outer metallic jacket described in greater detail below. As seen in FIG. 4, the annular member 40 includes one or more and preferably a pair of closed-form apertures 50 extending from the distal surface 44 to the proximal surface 42 between the internal and peripheral surfaces 46, 47. The apertures 50 are preferably closed-form in that they are defined by a closed boundary. The closed-form apertures 50 are preferably rectangular in geometry, but may be of an alternate geometry provided it permits engagement of the deflector assembly as described herein. The two apertures 50 are preferably opposed and more preferably diametrically opposed about the central axis of the annular member 50. The annular member 40 is further preferably oriented about the stanchions 22*a*, 22*b* so as to axially align and place the closed-form apertures 50 in communication with the channel 24, as seen for example in FIG. 3B. The closed-form apertures 50 define a receiver structure for engaging the deflector assembly 100. Moreover, the closed-form apertures 50 guide the axial translation of the deflector assembly with respect to the outlet 18*b*; and the proximal and distal surfaces 42, 44 of the annular member 40 limit the relative axial translation between the deflector assembly 100 and sprinkler frame 12.

A preferred deflector assembly 100 includes a deflector member 102 with a pair of extension members 104*a*, 104*b* disposed about and extending orthogonally to the deflector member 102. Referring to FIG. 2, the preferred deflector assembly 100 is preferably formed from metal and includes the deflector member 102 with one or more extension members or pillars 104*a*, 104*b* for engaging the annular member 40 and the apertures 50. In one preferred aspect, the deflector assembly 100 is stamped and bent from a metal such as, for example, a flat or planar bronze blank. The extension members 104*a*, 104*b* are preferably stamped with the deflector member 102 so as to locate the deflector member centrally between the extension members 104*a*, 104*b* defining a central axis of the deflector member for coaxial alignment with the annular member 40 and the longitudinal axis A-A The extension members 104*a*, 104*b* are preferably bent so as to extend preferably orthogonally from the deflector member 102.

Each of the extension members 104*a*, 104*b* are preferably formed with a flexible projection member 106 located preferably proximal of the deflector member 102. In one preferred embodiment, the projection member 106 is a tab cut from the extension members 104*a*, 104*b* and bent to extend from the extension members and form an included angle therebetween. The flexible projections members 106 of the extension members 104*a*, 104*b* are preferably resilient to permit axial insertion into the apertures 50 and the channel 24 of the stanchions 22*a*, 22*b*. Once located proximal of the aperture 50, the flexible projection 106 preferably extends laterally to form the included angle with the axially extending extension member 104*a*, 104*b*. With the preferred orientation of the closed-form apertures 50 in communication with the lateral channels 24 of the stanchions 22*a*, 22*b*, the apertures 50 locate the extension members 104*a*, 104*b* within the lateral channels 24.

In one preferred aspect, the deflector assembly 100 engages the support member 20 for translation from a first location relative to the outlet 18*b* in an unactuated state of the sprinkler assembly 10 to a second location relative to the outlet in an actuated state of the sprinkler assembly 10, the second location being distal of the first location. Preferably, the annular member 40 limits or controls the axial translation of the deflector assembly 100. Specifically, the distal surface 44 limits or defines the first location of the deflector assembly in the unactuated sprinkler by defining the minimum distance between the deflector member 102 and the outlet 18*b* when the deflector member 102 is supported in the proximal direction so as to abut or contact the distal surface 44 of the annular member 40. The deflector assembly 100 can be supported in the unactuated position by a thermally sensitive cover plate assembly, such as for example as shown in U.S. Patent Publication No. 2009/0126950. More preferably, the deflector assembly 100 is supported in the first unactuated location by a preferred cover plate assembly 300 described in greater detail below. Upon thermal activation of the sprinkler, the cover plate assembly 300 disengages, thereby removing support for the deflector assembly. Under the force of gravity and/or the water discharge from the outlet 18*b*, the deflector assembly 100 and its deflector member 102 axially and distally translate to its second position relative to the outlet 18*b*.

In the actuated state of the sprinkler assembly 10, the deflector assembly 100 is permitted to drop down or translate in the distal direction. In the preferred embodiment, the extension members 104*a*, 104*b* translate within the lateral channels 24 and the preferred projection member 106 of the extension members engages the proximal surface 42 of the annular member which acts as a stop or limit to locate the deflector member 102 and the deflector assembly 100 in its second most distal location relative to the sprinkler outlet 18*b* and the first location. Accordingly, the axial spacing of the projection member 106 and the deflector member 102 can define the amount of the translation of the deflector assembly 100.

The proximal surface 42 of the annular member 40 includes a surface for engagement with the projection members 106 of the deflector assembly. Preferably, the proximal surface defines a pair of engagement surfaces 52 disposed about the longitudinal axis for engaging the projection members 106 of the deflector assembly. Each of the engagement surfaces 52 are preferably disposed laterally of the aperture 50 along the proximal surface 42. Moreover, the engagement surfaces 52 extend proximally into the adjacent channels 24 from the proximal surface 42 of the annular member and oblique to the lateral surface of the stanchions 22*a*, 22*b* defining the channels 24. The angle of the engagement surfaces 52 limits the translation of the deflector assembly 100 by facilitating surface engagement with the projection member 106 of the extension members and provides a wedge engagement between the projection member 106 and the extension members 104*a*, 104*b* as seen, for example, in FIG. 3B.

Figure 3A:
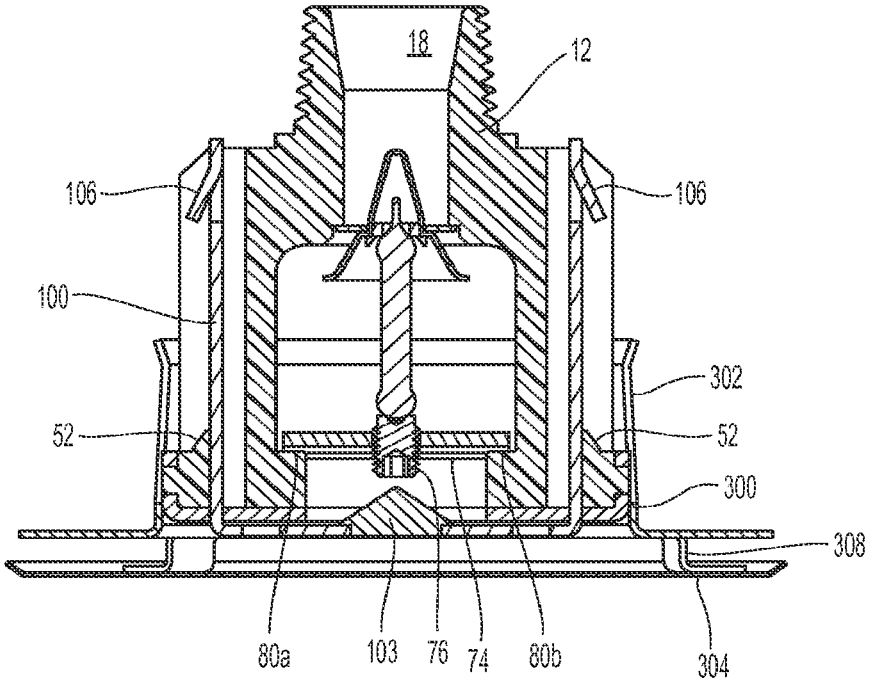
FIG. 3A is a cross-sectional view of the sprinkler assembly in an unactuated state.

Referring to FIGS. 1, 2, and 3A, the annular member 40 is also preferably configured to maintain the thermally responsive trigger assembly 60 and seal assembly 70 in their unactuated configurations preferably under a static fluid pressure up to about 500 psi. at the seal assembly 70. In a preferred sprinkler assembly arrangement, the trigger assembly 60 preferably includes a thermally responsive link or element in the preferred form of a glass bulb 60 such as, for example, a bulb shown and described in U.S. Pat. No. 4,796,710. Each of the seal assembly 70 and the annular member 40 are configured to load and maintain the trigger assembly 60 in a position aligned along and parallel to the sprinkler axis A-A, as seen in FIGS. 1 and 2. The seal assembly 70 includes a seat portion 72 to support the proximal end 60*a*. The assembly 10 includes an elongate bridge 74 and a load screw 76 to seat the distal end 60*b* of the trigger assembly 60. The load screw 76 is preferably threaded into the bridge 74 and includes a proximal tip for seating the distal end 60*b* of the bulb 60. In an installed, unactuated configuration, water delivered to the sprinkler assembly 10 loads the seal assembly with a pressure from about 175 psi to about 500 psi. The load is distributed over each of the engagements between the stanchion 22*a*, 22*b* and the proximal surface 42 of the annular member 40.

Preferably, the annular member 40, as seen in FIG. 4, includes a first support portion 80*a*, and a second support portion 80*b* formed medial of the closed-form apertures 50 to provide diametrically opposed support surfaces for supporting the ends of the bridge 74. More specifically, the internal surface 47 extends radially inward medial of the aperture 50 to provide a proximal surface for supporting the bridge 74. Under the static load, the first and second support portions 80*a*, 80*b* are preferably configured to support a pressure from about 175 psi to about 500 psi. at seal assembly 70.

To further strengthen the support member 20 in each of the actuated and unactuated states of the sprinkler assembly, a preferably metallic annular jacket 90, as seen in FIG. 3, is disposed about or formed with the sprinkler frame 12. More specifically, the annular jacket 90 is disposed about the annular member 40. However, it should be understood that the sprinkler assembly 10 and frame 12 can be assembled without the jacket 90 provided the frame 12 and its annular member 40 are constructed with a material of sufficient strength to support the deflector, closure and trigger assemblies as described. The annular jacket 90 preferably includes an annular wall 92 with a plurality of openings 94 having a geometry corresponding to formation or engagement with the projection members 48 of the annular member 40. The annular jacket 90 preferably includes a distal floor 96 which preferably mirrors the distal footprint of the sprinkler frame 12 and annular member 40, as shown in FIG. 4. Accordingly, the distal floor 96 includes the corresponding apertures or openings internal of the wall 92 to permit engagement of the deflector assembly with the closed-form apertures 50 of the annular member 40 and to permit fluid to flow from the outlet 18*b* to impact the deflector assembly 100. Although the jacket 90 is preferably metallic, it may be made from any other material applicable to fire applications provided it can add a desired strength to the annular member 40.

Figure 5:
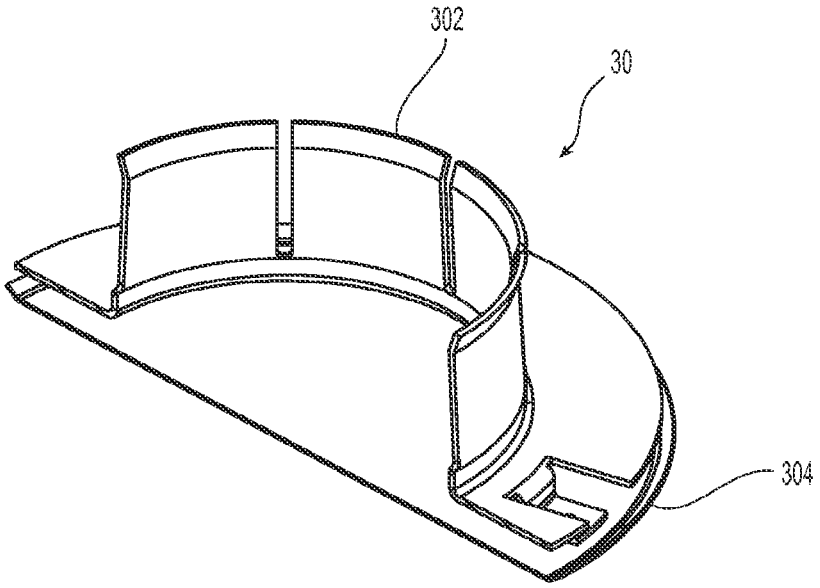
FIG. 5 is a perspective cross-sectional view of a cover plate assembly for use in the sprinkler assembly of FIG. 1.

Referring again to FIG. 3A with the sprinkler assembly shown in an unactuated state, the deflector assembly 100 can be supported in its first most proximal location by the preferred cover plate assembly 300. As seen in FIGS. 2 and 5, the cover plate assembly includes an outer ring member 302 and a cover plate 304. The outer ring member 302 preferably includes an annular wall 302*a* for preferably surrounding the annular member 40 and jacket 90 of the sprinkler assembly 10. The wall 302*a* includes a plurality of preferably radially spaced tabs 306 to provide resiliency to the wall 302*a*. The tabs 306 are preferably formed so as to define the proximal portion of the annular wall 302*a* with a flare that extends radially outward from the central axis of the cover plate assembly 300. The flare and the resiliency of the wall 302*a* preferably defines an internal surface of the cover plate assembly 300 that engages the distal end of a sprinkler assembly, for example, the annular member 40 of the sprinkler assembly 10. The proximal portion of the assembly permits the assembly to be pushed onto the sprinkler assembly at various angles with respect to the sprinkler axis A-A and then centered about the sprinkler frame 12. Moreover, the resiliency of the annular wall 302*a* provides a sufficient frictional engagement or grip about the sprinkler frame 12 and annular member 40 to maintain the annular wall 302*a* about the sprinkler frame. Preferably formed about the distal end of the annular wall 302*a* is the flange 302*b*. The flange 302*b* preferably includes a projection angle 308 to distally space the cover plate 304 from the outer ring 302. The cover plate 304 is coupled to the projection angle 308 by a fusible material for thermal release of the cover plate 304 in the event of a fire.

Figure 3B:
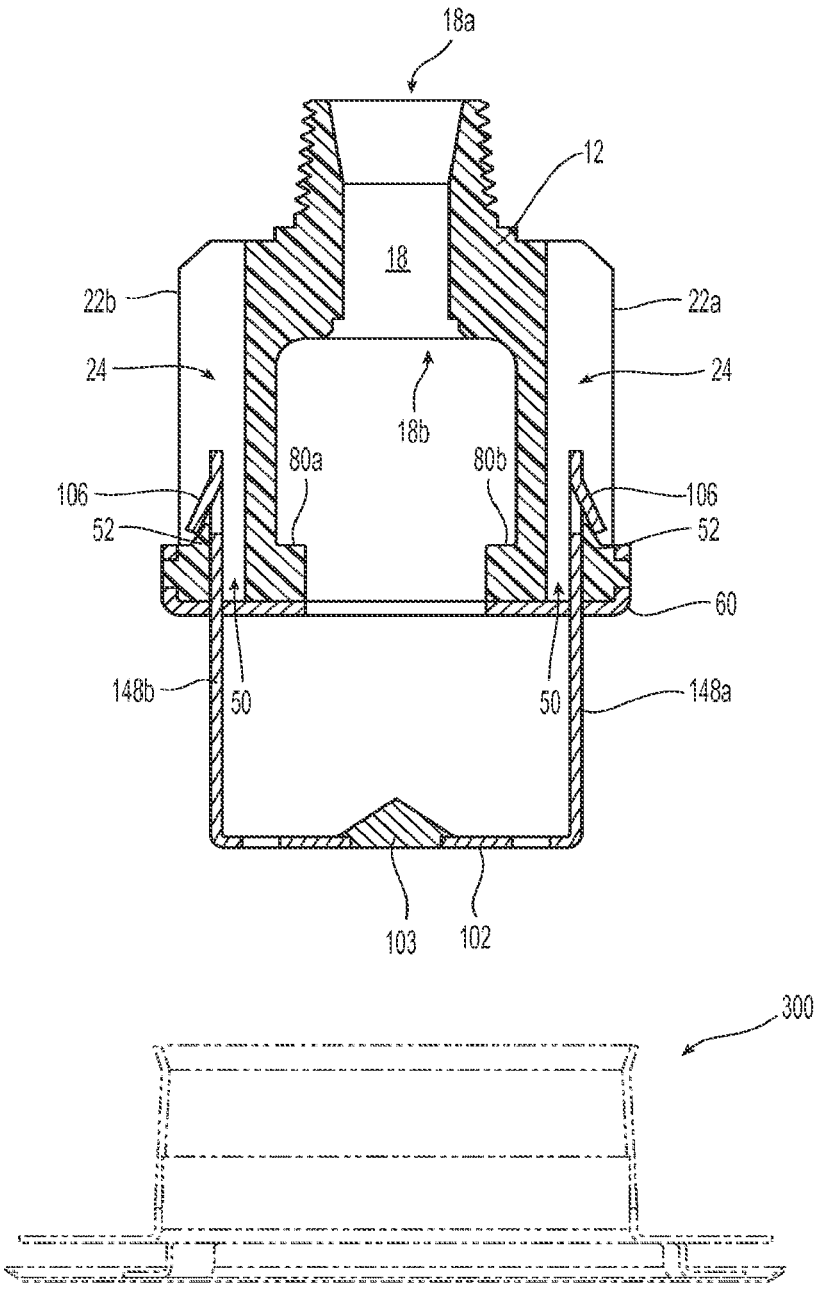
FIG. 3B is a cross-sectional view of the sprinkler assembly in an actuated state.
Figure 4:
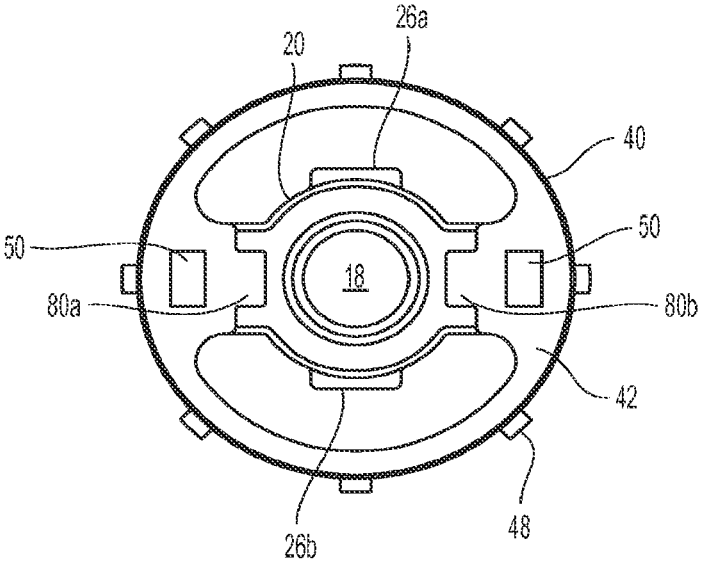
FIG. 4 is an end view of the sprinkler frame used in the sprinkler assembly of FIG. 1.

Referring to FIGS. 2, 3A and 3B, the deflector member 102 is shown as a substantially planar member having a plurality of spaced apart tines defining open ended slots. The deflector member 102 can also include one or more closed ended slots to define the spray distribution pattern of the deflector member 102. Moreover, preferably centrally disposed on the deflector member 102 is a deflecting projection member 103. The projection member 103 of the deflector assembly 100 is preferably conical in shape. The planar deflector member 102 has an outer perimeter defining a substantially oblong geometry and more preferably a rectangular geometry. It is to be understood that the deflector member 102 is shown generically and that the deflector members can be configured in a manner to distribute fluid (water) and address a fire in accordance with industry accepted standards. Accordingly, the deflector member 102 may define any geometry such that the sprinkler assembly performs in accordance with one or more industry accepted performance standards. For example, the deflector member can be circular and each of the slots extending radially toward the center of the deflector member, which is preferably axially aligned with the sprinkler axis A-A.

Provided the deflector member can be coupled to the sprinkler frame 12 in a manner and operation shown and described herein, the deflector member 102 and/or its deflecting projection member 103 may be defined by a known deflector geometry which satisfies one or more known industry performance standards. For example, residential automatic fire protection sprinklers are typically designed to specific performance criteria or standards that have been accepted by the industry. The performance criteria establishes the minimum performance standards for a given sprinkler to be considered sufficient for use as a residential fire protection product. For example, Underwriters Laboratories Inc. (UL) "Standard for Safety for Residential Sprinklers for Fire Protection Service" (March 2008) (Rev. April 2012) (hereinafter "UL 1626") is an accepted industry standard. The National Fire Protection Association (NFPA) also promulgates standards relating to residential fire protection such as, for example, NFPA Standard 13 (2013) (hereinafter "NFPA 13"). In order for a residential sprinkler to be approved for installation under NFPA Standards, such a sprinkler typically must pass various tests, for example, tests promulgated by UL under UL 1626, in order to be listed for use as a residential sprinkler. Specifically, UL 1626 generally requires a sprinkler to deliver a minimum flow rate (gallons per minute or "gpm") for a specified coverage area (square feet or "$ft^2$") so as to provide for a desired average density of at least 0.05 $gpm/ft^2$. In one particular embodiment, the deflector member 102 may be configured as a known residential deflector. Exemplary deflectors are shown and described in: U.S. Pat. Nos. 8,074,725; 7,201,234; 8,151,897; and U.S. Patent Application Publication Nos. 20090126950 and 20100263883.

Referring again to the illustrative cross-sectional view of the sprinkler assembly 10 in FIGS. 3A and 3B, the fluid passage can include a tapering portion that tapers narrowly in the distal direction and a constant diameter portion that is distal of and contiguous with the tapering portion. The passageway may alternatively have a constant width or taper at a constant rate, variable rate or combinations thereof along its entire length. The internal surface of the sprinkler frame 12 defines an internal fluid passageway 18 that extends axially from the proximal portion 14 preferably into the distal portion 16. The fluid passage 18 has an inlet 18*a* into which water is supplied and an outlet 18*b* from which the water is discharged for impacting the deflector assembly 100.

The fluid passage 18, inlet 18*a* and outlet 18*b* preferably define a sprinkler constant or K-factor which approximates the flow rate to be expected from an outlet of a sprinkler based on the square root of the pressure of fluid fed into the inlet of the sprinkler. As used herein and in the sprinkler industry, the K-factor is a measurement used to indicate the flow capacity of a sprinkler. More specifically, the K-factor is a constant representing a sprinkler's discharge coefficient that is quantified by the flow of fluid in gallons per minute (GPM) through the sprinkler passageway divided by the square root of the pressure of the flow of fluid fed to the sprinkler in pounds per square inch gauge (PSIG). The K-factor is expressed as $GPM/(PSI)^{1/2}$. Industry accepted standards such as, for example, the National Fire Protection Association (NFPA) standard entitled, "NFPA 13: Standards for the Installation of Sprinkler Systems" (2010 ed.) ("NFPA 13"), provide for a rated or nominal K-factor or rated discharge coefficient of a sprinkler as a mean value over a K-factor range. As used herein, "nominal" describes a numerical value, designated under an accepted standard, about which a measured parameter may vary as defined by an accepted tolerance ranging, i.e., plus or minus 5%. Exemplary industry accepted nominal K-factors (with the K-factor range shown in parenthesis) include the following: (i) 1.4 (1.3-1.5) $GPM/(PSI)^{1/2}$; (ii) 1.9 (1.8-2.0) $GPM/(PSI)^{1/2}$; (iii) 2.8 (2.6-2.9) $GPM/(PSI)^{1/2}$; (iv) 4.2 (4.0-4.4) $GPM/(PSI)^{1/2}$; (v) 5.6 (5.3-5.8) $GPM/(PSI)^{1/2}$; (vi) 8.0 (7.4-8.2) $GPM/(PSI)^{1/2}$; (vi) 8.0 (7.4-8.2) $GPM/(PSI)^{1/2}$; (vii) 11.2 (10.7-11.7) $GPM/(PSI)^{1/2}$; (viii) 14.0 (13.5-14.5) $GPM/(PSI)^{1/2}$; (ix) 16.8 (16.0-17.6) $GPM/(PSI)^{1/2}$; (x) 19.6 (18.6-20.6) $GPM/(PSI)^{1/2}$; (xi) 22.4 (21.3-23.5) $GPM/(PSI)^{1/2}$; (xii) 25.2 (23.9-26.5) $GPM/(PSI)^{1/2}$; and (xiii) 28.0 (26.6-29.4) $GPM/(PSI)^{1/2}$. The sprinkler frame and its internal passage 18 and outlet 18*b* can be configured to define a K-factor preferably ranging from a nominal 4.2 to a nominal 5.6 $GPM/(PSI)^{1/2}$, although other K-factors outside the preferred range can be possible.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler assembly comprising:

a body having an internal passageway extending from an inlet to an outlet to define a longitudinal axis;

a support member comprising a ring and a pair of stanchions disposed about the outlet, each of the stanchions defining a channel extending parallel to the longitudinal axis, each of the stanchions spacing the ring distally from the outlet with the ring circumscribing and orthogonal to the longitudinal axis, each of the stanchions having an opening between the channel and the ring; and a deflector assembly engaged with the support member to translate from a first location a second location further from the outlet than the first location, the deflector assembly including a deflector member and a pair of elongate members integrally formed with and extending from the deflector member, each elongate member being disposed in one of the channels and including a projection member that is compressible relative to a corresponding elongate member of the pair of elongate members, each projection member engages the ring in the second location of the deflector assembly, each projection member disposed at a first angle to define a space between the projection member and the corresponding elongate member, a proximal surface of the ring including a pair of engagement surfaces disposed about the longitudinal axis for engaging the projection members of the deflector assembly, each engagement surface extending proximally in one of the channels, each engagement surface disposed at a second angle and extending from a first surface end to a second surface end, the second surface end further from the longitudinal axis and the inlet than the first surface end to provide a wedge engagement between each projection member and corresponding engagement surface such that the corresponding engagement surface is received in the space defined by the projection member.

2. The sprinkler assembly of claim 1, comprising:

the proximal surface and a distal surface of the ring form a pair of closed-form apertures, each aperture extending from the distal surface to the proximal surface and in communication with one of the channels.

3. The sprinkler assembly of claim 1, comprising:

a thermally responsive trigger and a closure assembly at the outlet in an unactuated state of the sprinkler assembly.

4. The sprinkler assembly of claim 1, comprising:

the projection member is axially spaced from the deflector member and extends laterally from the elongate member to define the first angle as an oblique included angle with respect to the elongate member.

5. The sprinkler assembly of claim 1, comprising:

a bridge that supports a thermally responsive trigger and a closure assembly in the outlet in the unactuated state of the sprinkler assembly under a fluid static load ranging from 175 psi to 500 psi.

6. The sprinkler assembly of claim 1, comprising the body includes a pair of tool engagement surfaces disposed about the passageway and orthogonal to the stanchions.

7. The sprinkler assembly of claim 1, comprising:

the body includes one of an external thread, an internal thread, or an external groove.

8. The sprinkler assembly of claim 1, comprising:

the body and the support member are formed from a plastic material.

9. A sprinkler, comprising:

a sprinkler frame having an internal passageway extending along a longitudinal axis from an inlet to an outlet;

a seal assembly including a seal and a seal support at the outlet to prevent fluid from exiting the outlet;

a pair of stanchions disposed about the sprinkler frame defining a pair of spaced apart lateral channels, each stanchion including adjacent and orthogonally oriented surfaces to define one of the channels;

an annular member spaced distally from the outlet by the stanchions, the annular member having a proximal surface, a distal surface and a peripheral surface extending between the proximal and distal surfaces, the peripheral surface circumscribing the pair of lateral channels, the annular member including a pair of support surfaces disposed medially of the stanchions;

a thermally responsive trigger axially aligned along the longitudinal axis and supported by the support surfaces of the annular member to maintain the seal assembly at the outlet of the body; and a deflector assembly comprising:

a deflector member disposed distally of the annular member for translation relative to the outlet of the body, the deflector assembly engaging the distal surface of the annular member to define a first location, the deflector assembly engaging the proximal surface of the annular member in an actuated state of the sprinkler; and a pair of planar elongate members integrally formed with and extending from the deflector member, the pair of elongate members disposed in the pair of channels, each elongate member including a projection member compressible relative to each elongate member that engages the proximal surface, each projection member engages the annular member in the second location of the deflector assembly, each projection member disposed at a first angle to define a space between the projection member and the corresponding elongate member, each support surface extending proximally in one of the channels, each support surface disposed at a second angle and extending from a first surface end to a second surface end, the second surface end further from the longitudinal axis and the inlet than the first surface end to provide a wedge engagement between each projection member and corresponding support surface such that the corresponding support surface is received in the space defined by the projection member.

10. The sprinkler of claim 9, comprising:

the pair of elongate members extend through closed-form apertures which extend from the proximal surface to the distal surface of the annular member.

11. The sprinkler of claim 9, comprising:

the annular member includes a plastic annular member formed integrally with the stanchions and a metallic ring disposed about the plastic annular member, the support surfaces supporting a bridge extending between the support surfaces with the thermally responsive trigger and the seal disposed axially along the longitudinal axis.

12. The sprinkler of claim 9, comprising:

the proximal portion includes one of an external thread, an internal thread or an external groove.

13. The sprinkler of claim 9, comprising:

a bridge supporting a closure assembly and the thermally responsive trigger under a static load ranging from 175 psi to 500 psi.

14. The sprinkler of claim 9, comprising:

the pair of stanchions diametrically disposed about the outlet to space the annular member distally from the outlet.

15. The sprinkler of claim 9, comprising:

the sprinkler frame and the annular member are formed from a plastic material, the assembly further including an annular metallic support member circumferentially surrounding and engaged with the distal surface of the annular member.

16. The sprinkler of claim 9, comprising:

a pair of tool engagement surfaces disposed about the passageway and orthogonal to the stanchions.

17. The sprinkler assembly of claim 9, comprising:

a cover plate coupled with the sprinkler frame.

* * * * *